United States Patent [19]

Fitzner et al.

[11] 4,186,712

[45] Feb. 5, 1980

[54] RFI-SUPPRESSING IGNITION SYSTEM FOR AN INTERNAL COMBUSTION ENGINE

[75] Inventors: Arthur O. Fitzner; James R. Hager, both of Fond du Lac, WI

[73] Assignee: Brunswick Corporation, Fond du Lac, Wis.

[21] Appl. No.: 914,727

[22] Filed: Jun. 12, 1978

Related U.S. Application Data

[60] Continuation of Ser. No. 698,066, Jun. 21, 1976, which is a continuation of Ser. No. 516,990, Oct. 22, 1974, which is a division of Ser. No. 323,089, Jan. 12, 1973, Pat. No. 3,871,349.

[51] Int. Cl.[2] ..... F02P 1/00

[52] U.S. Cl. ..... 123/148 CB; 123/169 EL; 313/134; 123/143 C

[58] Field of Search ..... 123/143 C, 148 P, 148 A, 123/169 R, 169 EL, 148 CB; 313/134

[56] References Cited

U.S. PATENT DOCUMENTS

| | | | |
|---|---|---|---|
| 3,191,133 | 6/1965 | Texsier | 123/148 P |
| 3,267,325 | 8/1966 | Why | 315/53 |
| 3,686,607 | 8/1972 | Berry | 123/148 P |
| 3,723,809 | 3/1973 | Fujii | 123/149 A |
| 3,741,186 | 6/1973 | Doi et al. | 123/149 A |
| 3,771,006 | 11/1973 | Berry | 313/134 |
| 3,832,586 | 8/1974 | Podiak | 313/134 |
| 3,871,349 | 3/1975 | Hager | 123/169 |

FOREIGN PATENT DOCUMENTS

| | | | |
|---|---|---|---|
| 1148814 | 5/1963 | Fed. Rep. of Germany | 123/148 P |
| 1414592 | 3/1968 | Fed. Rep. of Germany | 313/134 |
| 1242482 | 8/1960 | France | 123/148 R |
| 155224 | 8/1932 | Switzerland | 123/148 |
| 200446 | 10/1938 | Switzerland | 123/148 |

*Primary Examiner*—Charles J. Myhre
*Assistant Examiner*—R. A. Nelli
*Attorney, Agent, or Firm*—Hopgood, Calimafde, Kalil, Blaustein & Lieberman

[57] ABSTRACT

The invention contemplates a capacitor-discharge ignition system which includes a particular low-resistance, low-inductance, wire-wound circuit element at the spark plug which is operative with the spark plug and with the rest of the ignition system to materially suppress RFI generated at the spark gap. In application to high-speed, high-power two-cycle engines, use of the invention does not adversely affect engine performance.

6 Claims, 4 Drawing Figures

RFI-SUPPRESSING IGNITION SYSTEM FOR AN INTERNAL COMBUSTION ENGINE

This is a continuation of application Ser. No. 698,066, filed June 21, 1976, which in turn is a continuation of application Ser. No. 516,990, filed Oct. 22, 1974, and said application Ser. No. 516,990 is a division of application Ser. No. 323,089, filed Jan. 12, 1973, now U.S. Pat. No. 3,871,349.

BACKGROUND OF THE INVENTION

Radio frequency interference (RFI) generated by outboard motors employing capacitor discharge (CD) ignition systems has been a long standing problem, and has caused such motors to be banned from use on certain lakes in Europe.

The environment in which a spark plug must operate in a high speed high compression two-cycle engine such as an outboard motor, motorcycle, or snowmobile, is vastly different from the environment within a four-cycle engine. The center electrode of an automobile type spark plug would overheat and effectively function as a glow plug in such engines and cause damaging preignition. In order to overcome this difficulty annular gap spark plugs which inherently operate at a much lower temperature are now almost universally employed. Unfortunately, the annular gap spark plug runs so cold that it has a tendency to foul, particularly when employed with the conventional inductive automobile type ignition system. Consequently, CD ignition systems are now almost universally employed on high power outboards and their use is gradually being expanded throughout the two-cycle engine field.

CD ignition systems are characterized by their speed of discharge, high voltage and high current across a larger spark gap. Typically, a CD ignition system will build up to 20 to 30 kv across the spark gap in 2 to 3 microseconds, compared to the inductive automotive type system which typically builds up to 10 to 15 kv in approximately 25 to 50 microseconds. The typical CD ignition coil high voltage secondary winding has only 1/10 to 1/5 the turns, and only 1/20 to 1/10 the ohmic resistance of the inductive automotive type secondary winding. The use of a larger spark gap further aids in combatting fouling.

As a result of the aforementioned characteristics of the CD ignition system, the electrical impulse generated upon the breakdown of its annular gap spark plug is significantly more powerful and has an effect on a wider spectrum of frequencies than similar impulses previously encountered. It is this oscillatory electrical impulse with its very high frequency, high voltage excursions in the wiring of the ignition circuit which is the source of RFI attributable to the plug itself.

In automotive inductive type ignition systems the traditional approach to the suppression of RFI has been to insert resistance in series with the secondary of the ignition circuit typically with values of 10,000 ohms or more. However, we have found that the use of added resistance in the secondary of a CD ignition circuit visibly diminishes the brilliant intensity of the spark, and measurably diminishes its duration. Such a resistance slows the discharge of energy through the spark gap and dissipates some of the potential spark energy in the form of useless heat. Further, it may be conclusively stated that insertion of a resistance in excess of approximately 1000 ohms in the body of the spark plug in an attempt to suppress RFI from a CD ignition system will adversely effect the performance of the engine and even this low value of resistance may cause a slight roughness at idle speeds. Therefore, the application of prior art teachings with respect to suppression of RFI through the use of resistors is impractical where CD ignition systems are employed.

It is an objective of the invention to overcome the aforementioned problems by providing a spark plug having a low resistance low inductance suppression element embodied therein, which spark plug will effectively suppress RFI generated by its spark gap; and it is a specific further objective to provide a spark plug which will accomplish the foregoing without degradation in the performance of the engine or ignition system in which it is employed.

It is another objective of the invention to provide a spark plug construction with the aforementioned qualities which is compatible with present methods and equipment for spark plug manufacture, and it is a further objective of the invention to provide a tamper proof suppression device which is in and of itself substantially effective in eliminating RFI from engines which employ CD ignition systems having no significant sources other than the gap discharges of the spark plugs themselves.

SUMMARY OF THE INVENTION

Basically, the invention comprises a spark plug body including a porcelain insulator retained within a metal body threaded for engagement within an engine block and a center electrode axially disposed within the insulator, including in electrical series therewith a low resistance low inductance suppression element disposed within the insulator suitable for suppressing RFI generated at the spark gap of the plug during its operation. The suppression element is preferably wire wound upon a core of high dielectric strength having an inductance of approximately 10 to 50 microhenries with a resistance as low as possible consistent with the size restrictions upon the element, i.e., its ability to fit within the center electrode cavity of the spark plug.

We have discovered that a simple wire wound inductor having a resistance of approximately 40 ohms and an inductance of approximately 40 microhenries, inserted in the center electrode cavity of a spark plug of existing design, is more than sufficient to suppress to an acceptable level RFI generated by the spark gap of a spark plug operating in a two-cycle engine with a breakerless, distributorless CD ignition system. However, it is reasonable to anticipate that the invention will be effective in any ignition system having no other powerful sources of RFI.

Further, applicants have found that when spark plugs of their invention are used with a CD ignition system having neither mechanical breaker points nor rotating distributor, that no further suppression means is required; so that the spark plugs of the invention are sufficiently self-suppressing to eliminate the need for especially constructed ignition harness wire, harness shielding or external shielding of the plug itself.

A primary advantage of the invention is the integral inclusion of a suppressing element within the body of a spark plug, which element in company with the inherent capacitance of an ignition system is effective in suppressing RFI generated by the spark plug, even when operating within high speed high compression two-cycle engines.

A further advantage of the invention is that it suppresses RFI interference generated by a spark plug with little or no degradation of spark intensity or duration, and with no adverse effect upon the performance of the engine in which it is installed.

Another advantage of the integral construction of the spark plug of the invention is that it prevents removal or bypassing of the suppressing element.

Still another advantage of the invention, and perhaps the most important, is that it is practical. The suppression elements described can and have been incorporated in existing spark plug bodies without substantial modification; and the performance and durability of this construction is both economically feasible and eminently satisfactory in the field.

A still further advantage of the spark plug construction of the invention is that it does not require the shunt capacitive filter elements as are shown in the construction of many prior art plugs.

DETAILED DESCRIPTION OF THE PREFERRED EMBODIMENT

Figure 1:
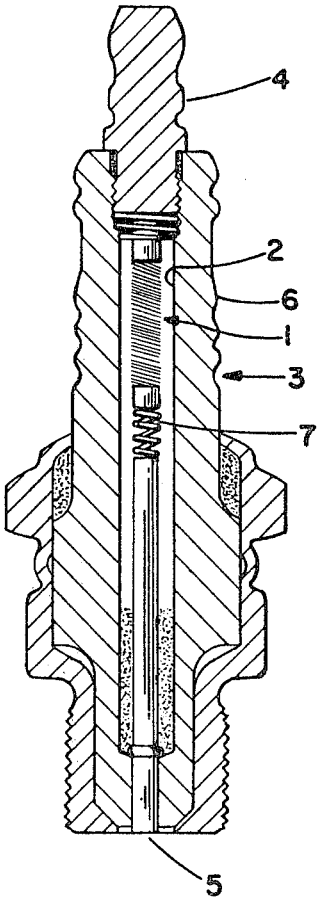
FIG. 1 is a vertical cross-section of a spark plug of the invention.

Referring now to FIG. 1, an inductive suppressor element 1 of the invention is inserted in the center cavity 2 of a common annular gap spark plug 3. The inductor element 1 is physically positioned between and in electrical series with an upper portion 4 and a lower portion 5 of the center electrode of the plug. The upper and lower portions of the center electrode may be anchored within the porcelain insulator 6 of the plug in any manner known to the art, and the inductor element 1 retained in series contact therebetween by a conducting compression spring 7.

Figure 2:
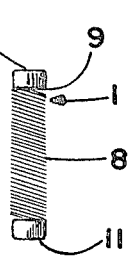
FIG. 2 is a side elevation of a suppressor element of the invention.

Referring to FIG. 2, a suppressor element 1 of the invention may be constructed by wrapping a coil 8 of fine wire tightly about a non-magnetic high dielectric strength core 9. The opposite ends of the coil may be connected to conducting end caps 10 and 11 secured at the respective ends of the core 9. An initial suppressor element 1 of the invention which proved to suppress RFI and to function successfully in a plug as illustrated in FIG. 1 consisted of a coil having one layer of 172 turns of number 44 A.W.G. wire wound onto a non-magnetic high dielectric strength rod ½" long and ⅛" in diameter. The ends of the coil wire were soldered to brass terminals which were embedded within the ends of the rod. The windings of the coil were then protected by a layer of high temperature, high dielectric strength varnish. The completed coil exhibited 18 ohms of resistance and 26 microhenries of inductance.

Although the physical construction of the spark plug and the inductor element 1 may vary considerably, the invention is directed primarily to the concept of including an inductor element of the type herein defined in the body of a spark plug, and to the range of values of resistance and inductance which have proved effective in suppressing RFI generated by high performance CD ignition systems without adversely effecting engine performance.

Figure 3:
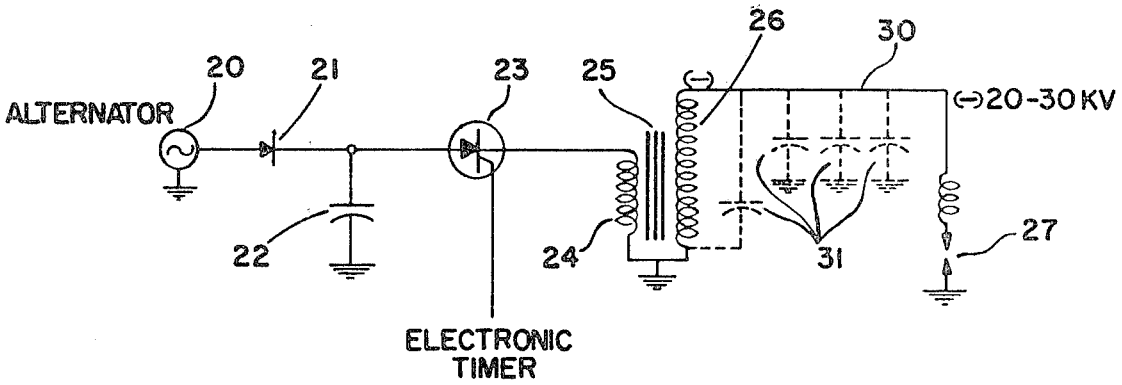
FIG. 3 is a simplified electrical schematic of a breakerless distributorless CD ignition system with which a plug of the invention may be advantageously used.

Referring to FIG. 3, a capacitor discharge ignition system typically comprises an alternator 20, a rectifying diode 21, and and energy storage capacitor 22. The energy stored in the capacitor 22 is delivered to the primary windings 24 of an ignition transformer 25 by an electronic switch 23. The surge of energy from the capacitor 22 through the primary windings 24 induces within the secondary winding 26 of the transformer a voltage potential which builds up to 20 to 30 kv before the spark occurs across the spark gap 27 of the spark plug. Capacitor discharge ignition systems are characterized by an extremely fast build-up of potential difference across the spark plug 27 as well as the amount of energy which may be stored in the stray capacitance 31 of the secondary circuit for virtually instantaneous discharge across the spark gap 27. The performance of CD systems is attributed in large part to the storage of energy in the stray capacitance 31 of the secondary winding 26 and the ignition lead 30; which energy is immediately available and is dumped through the spark gap 27 at the time of firing. Physical observation of such CD ignition systems reveal a brilliant spark signifying a high intensity discharge. Both the speed of voltage build-up and the peak discharge power of CD ignition systems aid greatly in eliminating spark plug fouling caused by the presence of fuel, oil or deposits in the neighborhood of the spark gap. To place a resistance in the path of the spark discharge would largely destroy the benefits of the CD ignition system. Further, tests have indicated that as pressure within the operating cylinders increases, resistance type suppressor elements lose their effectiveness much more quickly than the inductive elements of the invention. This effect is particularly noticeable at the mid-range engine speeds where the suppressor element of the invention continues to operate quite effectively. It has been estimated that the current produced across the spark gap by a CD system is 20 times that produced by the conventional inductive system. As power consumed may be equated to $I^2R$, the rate of energy loss to resistance in a CD system may be estimated to be many times the rate of energy loss to resistance in a conventional inductive system. It is, therefore, important that the resistance of the suppressor element 1 be held to a minimum consistent with unimpaired engine performance and practical plug construction.

Figure 4:
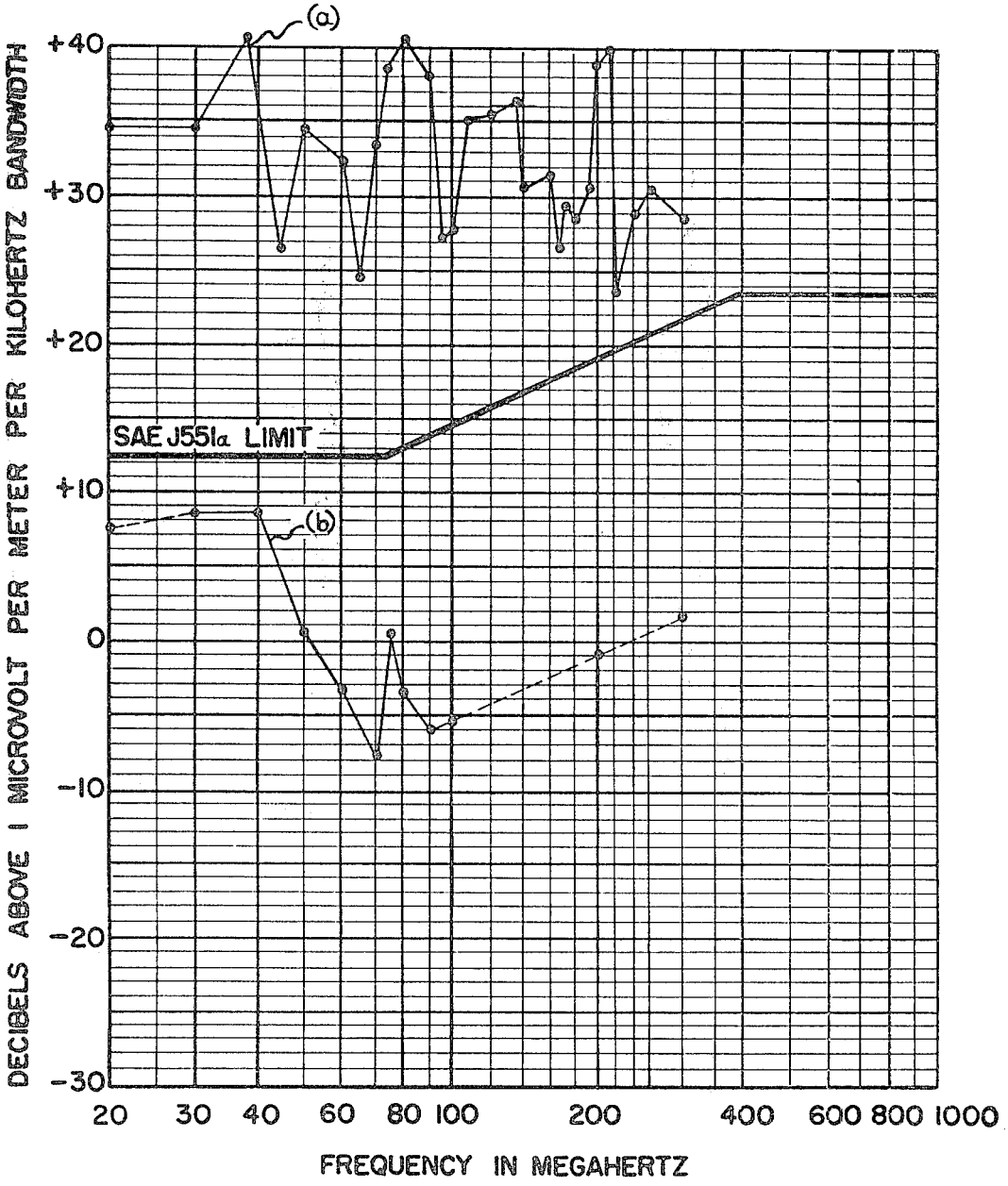
FIG. 4 is a comparative plot of RFI radiated by an engine operating (a) with prior art spark plugs, and (b) with spark plugs of the invention.

FIG. 4 represents the results of an RFI evaluation conducted utilizing a two cylinder 20 hp outboard motor with a breakerless CD ignition system. Each cylinder has its own electronic timing switch, ignition transformer, and spark plug. With the engine running at 1500 rpm, and a vertical antenna to one side of the engine, plot (a) represents the interference generated by the spark gap of a non-suppressor type plug with an annular gap of 0.072 inches. Plot (b) represents the interference under the same conditions generated by the spark gap of a plug constructed generally as herein described having a resistance of approximately 40 ohms and an inductance of approximately 40 michrohenries and an annular gap of 0.050 inches. The central reference line represents RFI limitations recommended by the Society of Automotive Engineers, in SAE Standard J551a. The dotted portion of plot (b) beyond 100 megahertz is estimated, as no actual interference was detected.

Tests have been conducted on various spark plugs of the construction described herein with resistance in the suppressor element ranging from 18 ohms to 40 ohms, with corresponding values of inductance ranging from 25 microhenries to 40 microhenries. While suppression of RFI remained below the prescribed standards on all tests, the best results, represented by FIG. 4, were obtained with a suppressor element having a resistance of approximately 40 ohms and an inductance of 40 microhenries. Higher inductance values may prove more effective from a suppression standpoint but are difficult to achieve within the physical limitations of the element, and are more likely to adversely effect engine performance. Also, it is quite likely that inductance values as low as 10 microhenries are sufficient for effective RFI suppression, and there is some indication that it may be necessary to go that low to further reduce the impedance of the suppressor to avoid adverse effect upon the CD ignition system. The effective impedance of this inductance theoretically ranges from 5000 ohms to 0.25 megohms over a frequency range of from 20 to 1000 megahertz; however, it is doubtful if the higher value can be achieved when the inherent capacitance of the plug and the suppressor element are considered.

Applicants believe that the reasons for the remarkable effectiveness of the inductor spark plug on CD ignition systems having no mechanical breaker points or mechanical distributor are the following:

(1) There are no arcing contacts other than the spark plug gap(s).

(2) The inductance of the spark plug suppressor cooperates with the stray capacitance of the CD ignition secondary circuit, in particular the stray capacitance to engine block ground of the CD ignition coil secondary winding, together forming a low pass LC filter driven by the spark discharge, which in turn drives the high voltage ignition lead as a transmitting antenna. While the low pass LC filter does not eliminate the very high voltage transient oscillation on the high voltage ignition lead, it does very substantially reduce the frequency of that very high voltage oscillation to a relatively very low frequency.

(3) As a transmitting antenna, the high voltage ignition lead is rendered essentially ineffective by the relatively very low frequency at which it is thus driven.

(4) The stray capacitances from the high voltage ignition lead to elements of the surrounding engine cowling are also rendered essentially ineffective in transferring currents into the cowling, by virtue of the relatively very low frequency at which these stray capacitances are driven.

The precise structure of the suppressor element may vary; however, it is sufficient for the practice of the invention that certain desirable construction principles be recognized and certain unavoidable construction restraints be accepted.

For practicality, the maximum physical dimensions of the suppressor element may be limited by the size of the cavity within a spark plug insulator; within these limitations the suppressor should be as long as possible. If a compression spring is used to assure electrical contact, it should be made as short as possible. By making the suppressor as long as possible, the ability of the suppressor to withstand the high transient voltages developed across the length of the suppressor is maximized.

By making the suppressor as long as possible, the stray capacitance bridging the suppressor will be minimized, and more turns of wire can be used, which will increase the inductance and reduce the transient voltage between turns. Similarly, within the space limitations of the insulator cavity, the overall suppressor diameter should be as large as possible to improve the mechanical strength of the suppressor, and increase the inductance obtained with a given number of turns.

The core of the coil should have a high dielectric strength, so as to withstand the high transient voltages developed between the two end caps of the suppressor element. The winding should be an evenly spaced single layer winding to better withstand the high transient voltages developed across the winding so as to obtain an approximately equal distribution of the voltage stress between turns, and to alleviate the problems of automating the production of such windings.

It is anticipated that future studies may show that there is a greater transient voltage per turn developed within the first few turns nearest the spark plug gap; if so, it would be desirable to increase the spacings between these first few turns as is done in many ignition coils.

The necessarily small cross-section wire used for the inductive winding should have as high a conductivity as possible, consistent with the other requirements that it be reasonable in cost, mechanically strong enough to be employed in automated winding machinery, and resist the oxidation or corrosion effects of its environment at those times when the bare metal may be exposed.

The turns of the winding must be insulated from one another, and must be prevented from slipping sideways such that an undesired electrical contact is formed between turns. The fine cross-section wire of the suppressor must be protected from nicking or chafing at all times. The turns should not unwind when the ends of the winding are being prepared for the terminal end caps. The above requirements suggest an insulating coating that can insulate between turns, anchor the winding to the core, protect against nicking and chafing, raise the dielectric breakdown voltage between turns, and protect any bare wire from oxidation or corrosion influences.

The end terminal caps 10 and 11 may vary in their construction, but must fulfill certain requirements: they must make secure electrical contact to the fine wire of the winding, they must be solidly anchored to the suppressor, and they must be rugged enough to withstand the compression force and the vibration forces acting on the suppressor.

The end caps should be short, such that the useful length of the inductive winding is not greatly reduced by the application of the end caps, and so that the stray capacity bridging the winding is minimized.

The end caps may advantageously be slightly larger in diameter than the winding diameter which will allow the suppressor to be handled by the more rugged end caps, and which further prevents the inside walls of the insulator cavity from touching and damaging the suppressor winding during operation of the engine.

If future studies show that one end of the inductive winding should have a few widely spaced turns (a "surge-winding" section) then end caps of two different maximum diameters could be used to mechanically code the proper end of the suppressor to be nearest the spark plug gap. By proper design of the spark plug insulator cavity and the suppressor end caps, correct insertion of such an unsymmetrical suppressor could be assured.

What is claimed is:

1. An ignition system for an internal combustion engine capable of operating with substantially reduced radiation of radio frequency interference, comprising in combination; a breakerless and mechanically distributorless capacitor discharge ignition system, and an inductor spark plug, said spark plug having a center electrode and an inductor element in electrical series therewith, said center electrode and inductor element being enclosed within an insulator body of the spark plug, and said inductor element having a resistance of between 10 and 100 ohms and an inductance of between 10 and 100 microhenries, whereby the inductance of said element will necessarily coact with the inherent capacitance of the ignition system to substantially reduce radiation of radio frequency interference.

2. In combination; a capacitor discharge ignition system including a power source, an energy storing capacitor, an ignition coil and electronic switching means for electrically connecting said ignition coil to said capacitor at the time of firing, and an inductor spark plug comprising a low resistance low inductance RFI suppressor element encased in the insulator thereof, said element having a resistance, of between 10 and 100 ohms and an inductance of between 10 and 100 microhenries, said combination substantially eliminating RFI generated at the spark gap of the spark plug through coaction of the spark-plug inductance with the inherent capacitance of said ignition system.

3. The combination of claim 2 in combination with a multicombustion chamber engine wherein an ignition coil is provided for each of a plurality of spark plugs each associated with a combustion chamber of said engine.

4. A capacitor discharge ignition system including power-source connection means, an ignition coil and electronic switching means for electrically connecting said ignition coil to said capacitor at the time of firing, and a spark plug having an insulator-mounted center electrode, an external terminal for circuit connection of said electrode, and a coiled winding series-connecting said terminal to said electrode, said coiled winding having a resistance of between 10 and 100 ohms and an inductance of between 10 and 100 microhenries.

5. The system of claim 4, wherein said inductance is less than 50 microhenries.

6. An ignition system for an internal combustion engine capable of operating with substantially reduced radiation of radio frequency interference, comprising in combination; a breakerless and mechanically distributorless ignition system including an output coil, and an inductor spark plug directly connected to said output coil, said spark plug having a center electrode and an inductor element in electrical series therewith, said center electrode and inductor element being enclosed within an insulator body of the spark plug, and said inductor element having a resistance of between 10 and 100 ohms and an inductance of between 10 and 100 microhenries, whereby the inductance of said element will necessarily coact with the inherent capacitance of said ignition output coil to substantially reduce radiation of radio frequency interference.

* * * * *